US011005226B2

(12) United States Patent
Shimada

(10) Patent No.: US 11,005,226 B2
(45) Date of Patent: May 11, 2021

(54) WIRE WITH TERMINAL PRODUCTION METHOD, CRIMPING TOOL AND WIRE WITH TERMINAL

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventor: Takanobu Shimada, Mie (JP)

(73) Assignees: AutoNetworks Technologies, Ltd.; Sumitomo Wiring Systems, Ltd.; Sumitomo Electric Industries, Ltd.

( * ) Notice: Subject to any disclaimer, the term of this patent is extended or adjusted under 35 U.S.C. 154(b) by 178 days.

(21) Appl. No.: 15/768,954

(22) PCT Filed: Oct. 4, 2016

(86) PCT No.: PCT/JP2016/079419
§ 371 (c)(1),
(2) Date: Apr. 17, 2018

(87) PCT Pub. No.: WO2017/068965
PCT Pub. Date: Apr. 27, 2017

(65) Prior Publication Data

US 2018/0309255 A1 Oct. 25, 2018

(30) Foreign Application Priority Data

Oct. 21, 2015 (JP) ..... JP2015-207202

(51) Int. Cl.
*H01R 43/04* (2006.01)
*H01R 43/048* (2006.01)
(Continued)

(52) U.S. Cl.
CPC ..... *H01R 43/048* (2013.01); *H01R 4/185* (2013.01); *H01R 43/058* (2013.01)

(58) Field of Classification Search
CPC .... H01R 43/048; H01R 43/058; H01R 4/185; Y10T 29/49185; Y10T 29/53209; Y10T 29/53235
(Continued)

(56) References Cited

U.S. PATENT DOCUMENTS 3,955,044 A * 5/1976 Hoffman ..... H01R 4/203 174/84 C
6,658,725 B1 * 12/2003 Liu ..... H01R 43/058 29/33 M
(Continued)

FOREIGN PATENT DOCUMENTS

JP 2005-50736 2/2005
JP 2009-87848 4/2009
(Continued)

OTHER PUBLICATIONS

International Search Report dated Dec. 27, 2016.

*Primary Examiner* — Donghai D Nguyen
(74) *Attorney, Agent, or Firm* — Gerald E. Hespos; Michael J. Porco; Matthew T. Hespos

(57) ABSTRACT

A wire/terminal production method includes placing a core on a bottom plate and crimping wire barrels to the core by a crimping tool. The crimping tool includes a first tool having a placing surface on which the bottom plate and the core are placed, and a second tool having a curved surface for curving the wire barrels toward the placing surface. The curved surface has a first inclined surface inclined out on a first end in an extending direction of the wire, a second inclined surface inclined out on a second end in the extending direction and a contact surface located between the inclined surfaces. A dimension of the curved surface in the extending direction exceeds a dimension of the wire barrels in the extending direction. A dimension of the contact
(Continued)

surface in the extending direction is no greater than the dimension of the wire barrels in the extending direction.

8 Claims, 8 Drawing Sheets

(51) Int. Cl.
*H01R 43/058* (2006.01)
*H01R 4/18* (2006.01)

(58) Field of Classification Search
USPC ..... 29/857, 863, 865, 747, 753
See application file for complete search history.

(56) References Cited

U.S. PATENT DOCUMENTS

| | | | | |
|---|---|---|---|---|
| 7,931,510 | B2 * | 4/2011 | Fukase ..... | H01R 4/185<br>439/442 |
| 2016/0276793 | A1 | 9/2016 | Terasaka | |

FOREIGN PATENT DOCUMENTS

| | | |
|---|---|---|
| JP | 2009-152054 | 7/2009 |
| JP | 2009-187786 | 8/2009 |
| WO | 2015/083659 | 6/2015 |

* cited by examiner

| angle | picture |
| --- | --- |
| 0 |  |
| 5 |  |
| 10 |  |
| 20 |  |
| Conventional example |  |

WIRE WITH TERMINAL PRODUCTION METHOD, CRIMPING TOOL AND WIRE WITH TERMINAL

BACKGROUND

Field of the Invention

This specification relates to a wire with terminal production method, a crimping tool and a wire with terminal.

Description of the Related Art

Japanese Unexamined Patent Publication No. 2005-50736 discloses a wire and a terminal connected by crimping wire barrels on the terminal to a core exposed at an end of the wire. Such crimping of the wire barrels to the core is performed by a crimping tool. Specifically, the core is overlapped on the wire barrels placed on a base, and the crimping tool is lowered toward the base. Thus, the entire wire barrels are deformed gradually to embrace the core along the shape of the crimping tool, and tip parts of the wire barrels are caused to bite into the core.

However, if a wire barrel is crimped to a core using a conventional crimping tool, a strong force is applied to parts of a wire barrel 125 in contact with end edge parts (end edge parts in an axial direction of a terminal) of a crimping tool 141, as shown in FIGS. 7 and 8 herein. Thus, end parts of the wire barrel 125 are lifted, a compressed core 112 is pushed up, and a bottom plate 124 of a terminal 121 is extended locally to produce a part 124T thinner than other parts.

This specification aims to provide a wire with terminal in which partial thinning of the terminal is avoided.

SUMMARY

This specification is directed to a production method for a wire with terminal in which a terminal including a bottom plate and two wire barrels extending laterally from the bottom plate are crimped to a core exposed at an end of a wire. The method includes placing the core on the bottom plate portion, and winding and crimping the wire barrels to the core by a crimping tool. The crimping tool includes a first tool having a placing surface on which the bottom plate and the core are to be placed, and a second tool having a curved surface for sandwiching and curving the wire barrels between the curved surface and the placing surface. The curved surface has a first inclined surface inclined out on one end in an extending direction of the wire, a second inclined surface inclined out on the other end in the extending direction and a contact surface located between the first and second inclined surfaces. A dimension of the curved surface in the extending direction is larger than a dimension of the wire barrels in the extending direction, and a dimension of the contact surface in the extending direction is equal to or smaller than the dimension of the wire barrels in the extending direction.

This specification also is directed to a crimping tool for crimping a pair of wire barrels to a core in the manufacturing of a wire with terminal. The terminal includes a bottom plate and two wire barrels extending laterally from the bottom plate. The wire barrels are crimped to the core exposed at an end of a wire. The crimping tool includes a first tool having a placing surface on which the bottom plate and the core are to be placed, and a second tool having a curved surface for sandwiching and curving the wire barrels between the curved surface and the placing surface. The curved surface has a first inclined surface inclined out on one end in an extending direction of the wire, a second inclined surface inclined out on the other end in the extending direction and a contact surface located between the first and second inclined surfaces. A dimension of the curved surface in the extending direction is larger than a dimension of the wire barrels in the extending direction, and a dimension of the contact surface in the extending direction is equal to or smaller than the dimension of the wire barrels in the extending direction.

According to the above-described wire with terminal production method and the crimping tool, the first and second inclined surfaces contact and press end parts (end parts in the extending direction of the wire) of the wire barrels that would otherwise be lifted in a direction away from the core, thereby suppressing excessive lifting in the process of crimping the wire barrels to the core. Thus, the barrel-side first inclined portions and the barrel-side second inclined portions formed on the wire barrels, i.e. bell-mouths, are not formed in the course of nature, but formed while inclination angles are controlled by the crimping tool (second tool).

In this way, the concentration of stress on parts of the wire barrels (parts contacted by the end parts of the contact surface) is suppressed and partial thinning of the terminal is avoided so that a wire with terminal with high quality is obtained. Further, partial thinning of the terminal is avoided and quality is high in the above-described wire with terminal production method and the above-described wire with terminal produced using the crimping tool.

Note that inclination angles of the first and second inclined surfaces with respect to the contact surface are both within a range of 0° or larger and 20° or smaller. This is because the inclination angles are close to angles when the inclined portions are formed in the course of nature as before, and stress partially (parts contacted by the end parts of the contact surface) applied to the wire barrels becomes larger if the inclination angles exceed 20°. More preferably, the inclination angles are about 10°.

This specification also is directed to a wire with terminal in which a terminal including a bottom plate and two wire barrels extending laterally from the bottom plate are crimped to a core exposed at an end of a wire. The wire barrels are wound and crimped to the core disposed on the bottom plate. The wire barrel includes a barrel-side first inclined portion inclined in a direction away from the core on one end in an extending direction of the wire, a barrel-side second inclined portion inclined in the direction away from the core on the other end in the extending direction and a body located between the barrel-side first and second inclined portions, and inclination angles of the barrel-side first and second inclined portions with respect to a ridge of the body extending in the extending direction are both within a range of 0° or larger and 20° or smaller.

According to this specification, it is possible to provide a wire with terminal in which partial thinning of a terminal crimped to a wire is avoided.

DETAILED DESCRIPTION

Figure 1:
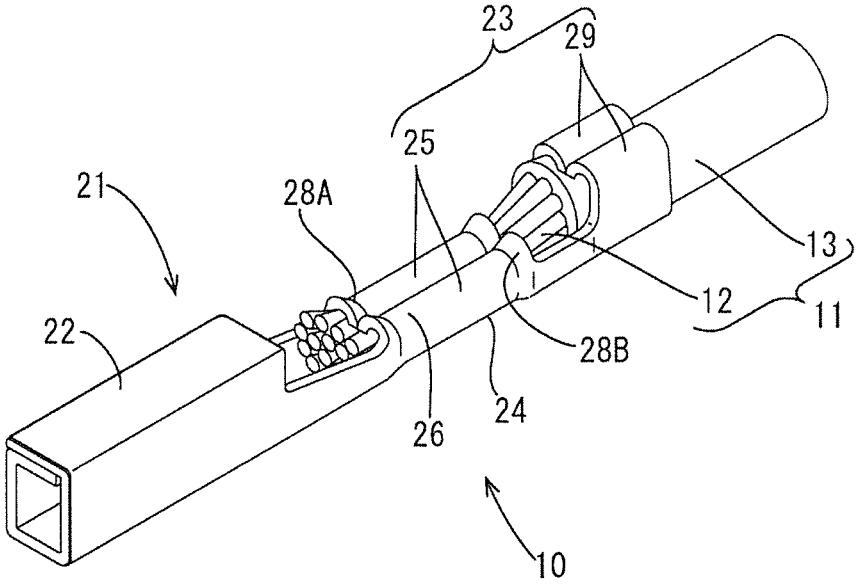
FIG. 1 is a perspective view of a wire with terminal of one embodiment.

One embodiment is described with reference to FIGS. 1 to 6. In the following description, a left lower side, a right upper side, an upper side and a lower side of FIG. 1 are referred to as a front side, a rear side, an upper side and a lower side. Further, a direction from a right lower side to a left upper side of FIG. 1 is referred to as a lateral direction (width direction).

A wire with terminal 10 of this embodiment is produced by crimping a female terminal 21 to an end of a wire 11 using a crimping tool 30.

(Wire with Terminal 10)

As shown in FIG. 1, the wire with terminal 10 includes the wire 11 and the female terminal 21 to be crimped to the end of this wire 11.

(Wire 11)

The wire 11 includes a core 12 formed by spirally twisting thin metal wires, and an insulation coating 13 made of resin covers the core 12. The insulation coating 13 is stripped at an end part of the wire 11 to expose the core 12. In this embodiment, the core 12 is made of aluminum or aluminum alloy.

(Female Terminal 21)

The female terminal 21 is produced by stamping and bending a metal plate material. A plate material made of copper or copper alloy and having tin plating applied to a surface can be used as the metal plate material for the female terminal 21.

As shown in FIG. 1, this female terminal 21 includes a terminal connecting portion 22 to be connected to a mating terminal and a wire connecting portion 23 to be crimped to the end of the wire 11. The terminal connecting portion 22 is a rectangular tube for receiving a male tab (not shown) of the mating terminal inside.

The wire connecting portion 23 includes a long narrow bottom plate 24 that is continuous rearward from the terminal connecting portion 22. Two wire barrels 25 are continuous from this bottom plate 24 and two insulation barrels 29 likewise are continuous from the bottom plate 24. The wire is to be arranged along bottom plate 24.

The wire barrels 25 extend laterally (in a direction intersecting an extending direction E of the wire 11) from the bottom plate 24 and are arranged to enclose the core 12 exposed from the insulation coating 13 at the end of the wire 11. The wire barrels 25 are arranged to face each other and are crimped to the core 12 to squeeze the core between the wire barrels 25 and the bottom plate 24.

The wire barrel 25 crimped to the core 12 includes: a body 26 arranged in a central part in a front-rear direction and held in close contact with the core 12, a front tapered portion 28A (example of a first inclined portion) disposed on a front end part of the body 26 and spreading out in a direction away from the core 12 and a rear tapered portion 28B (example of a second inclined portion) disposed on a rear end part of the body 26 and spreading out in the direction away from the core 12.

The body 26 of each of the wire barrels 25 faces the mating body 26, is curved toward the core 12 to approach the mating body 26 and is bent in so that a tip part (end opposite to the bottom plate 24) bites into the core 12. The tip part butts against the mating tip part.

On the other hand, the insulation barrels 29 extend laterally (in the direction intersecting the extending direction E of the wire 11) from the bottom plate 24 behind the wire barrels 25 and are crimped to the insulation coating 13 of the wire 11.

(Crimping Tool 30)

Figure 2:
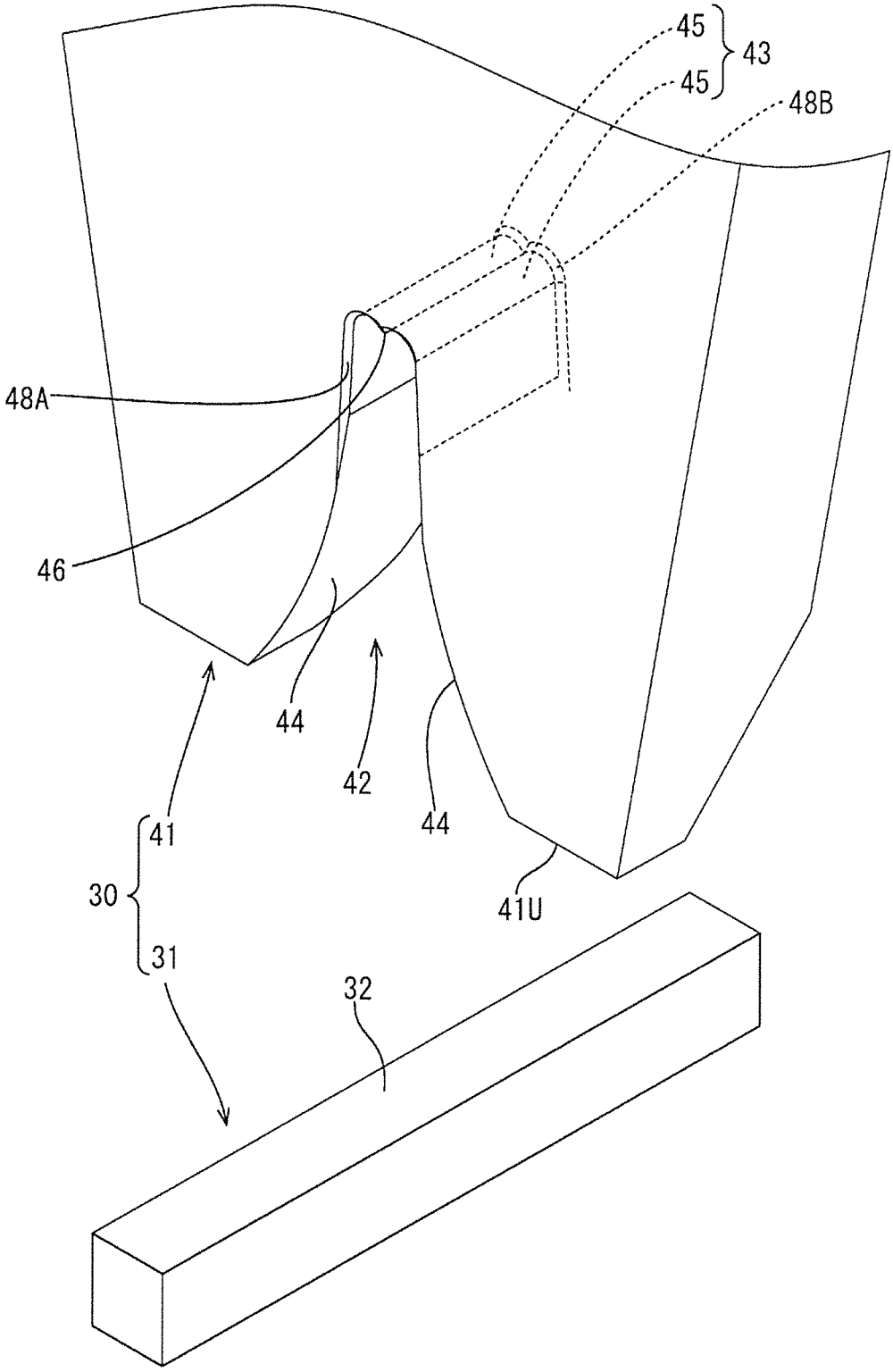
FIG. 2 is a perspective view of a crimping tool.

As shown in FIG. 2, the crimping tool 30 is composed of an anvil 31 (example of a first tool) and a crimper 41 (example of a second tool). The anvil 31 is a base on which the female terminal 21 is to be placed. The crimper 41 is disposed to face the anvil 31 and is configured to sandwich and curve the wire barrels 25 between the anvil 31 and the crimper 41 and to crimp the wire barrels 25 to the core 12.

The anvil 31 is the base made of metal and, as shown in FIG. 2, the upper surface serves as a placing surface 32 on which the female terminal 21 is to be placed.

As shown in FIG. 2, the crimper 41 is in the form of a thick plate made of metal and is arranged to face the anvil 31 from above the anvil 31. The crimper 41 has a lower surface 41U disposed in parallel to the placing surface 32 of the anvil 31.

The crimper 41 includes a barrel pressing portion 42 (example of a curved surface). The barrel pressing portion 42 is a tunnel-like member extending in the front-rear direction and is configured to receive the female terminal 21 and a part of the anvil 31 inside when the female terminal 21 is crimped to the wire 11. The crimper 41 is recessed up (toward a side opposite to the anvil 31) from the lower surface 41U.

An inner wall of the barrel pressing portion 42 includes a ceiling wall 43, two side walls 44 and two tapered walls 48A, 48B.

Figure 3:
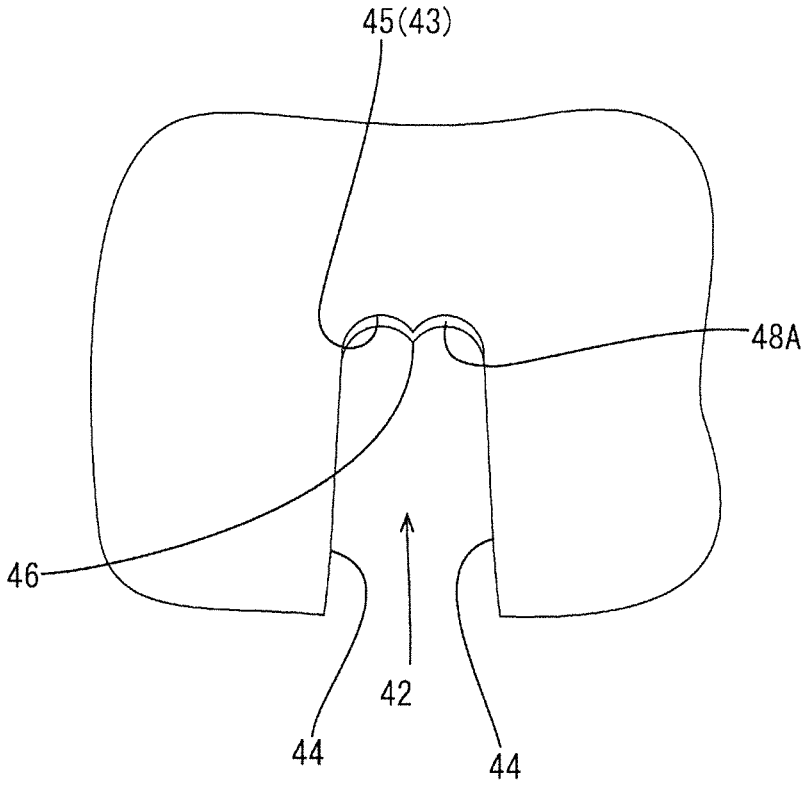
FIG. 3 is a front view of the crimping tool (second tool).

The ceiling wall 43 (example of a contact surface) is located above and opposite to the anvil 31 at a distance from the lower surface 41U. As shown in FIGS. 2 and 3, the ceiling wall 43 is formed such that two U-shaped grooves 45 extending in the front-rear direction are arranged in parallel in a width direction (direction perpendicular to a penetration direction of the barrel pressing portion 42) of the crimper 41. A part between the two U-shaped grooves 45 projects down (toward the anvil 31) and serves as a projection 46 continuously extending in the front-rear direction.

As shown in FIGS. 2 and 3, each of the side walls 44 extends to the lower surface 41U from an end edge of each U-shaped groove 45 opposite to the mating U-shaped groove 45. The side walls 44 face each other.

Figure 4:
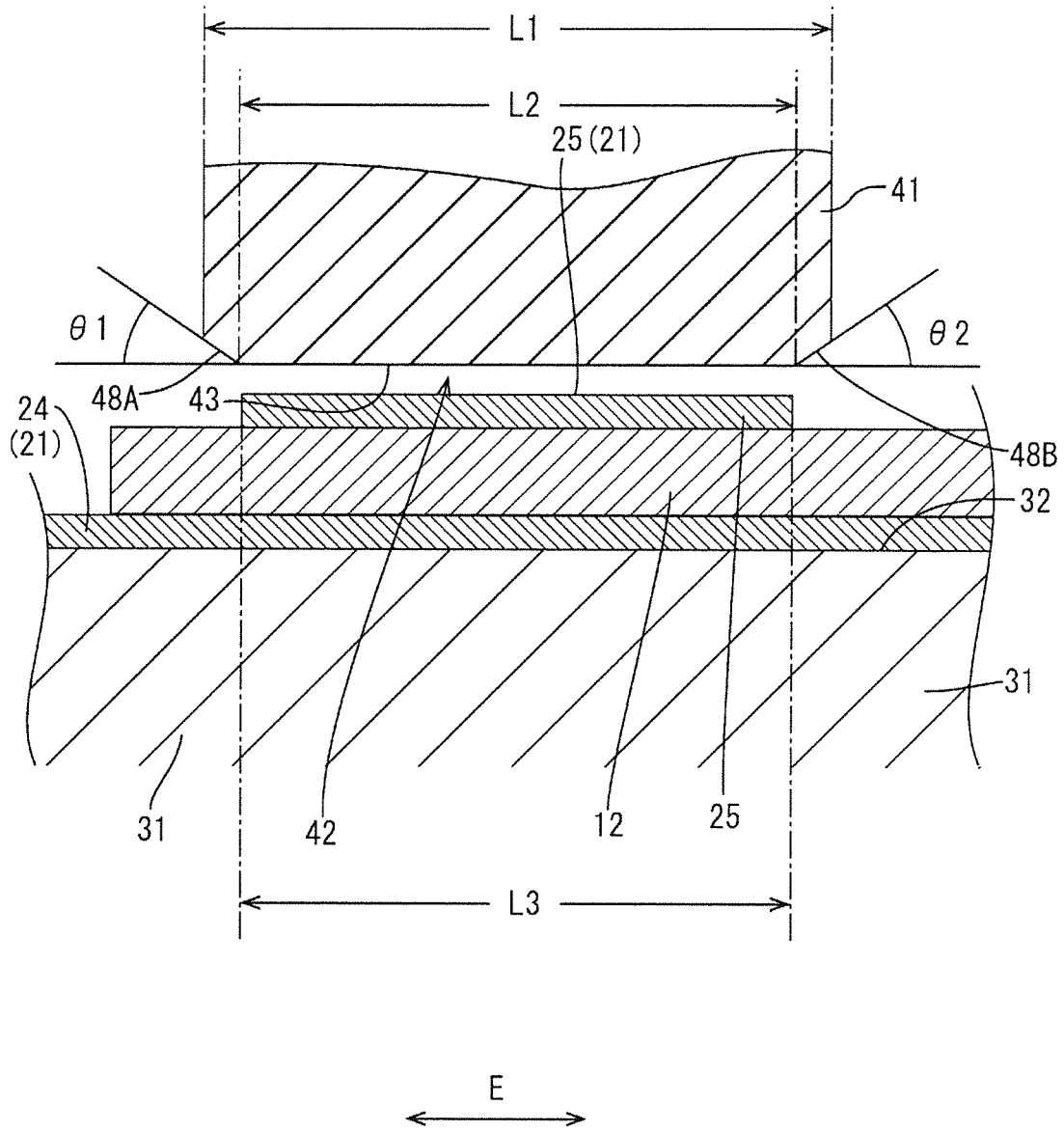
FIG. 4 is a partial enlarged side view in section conceptually showing the crimping tool and a wire barrel before being crimped to a core.
Figure 5:
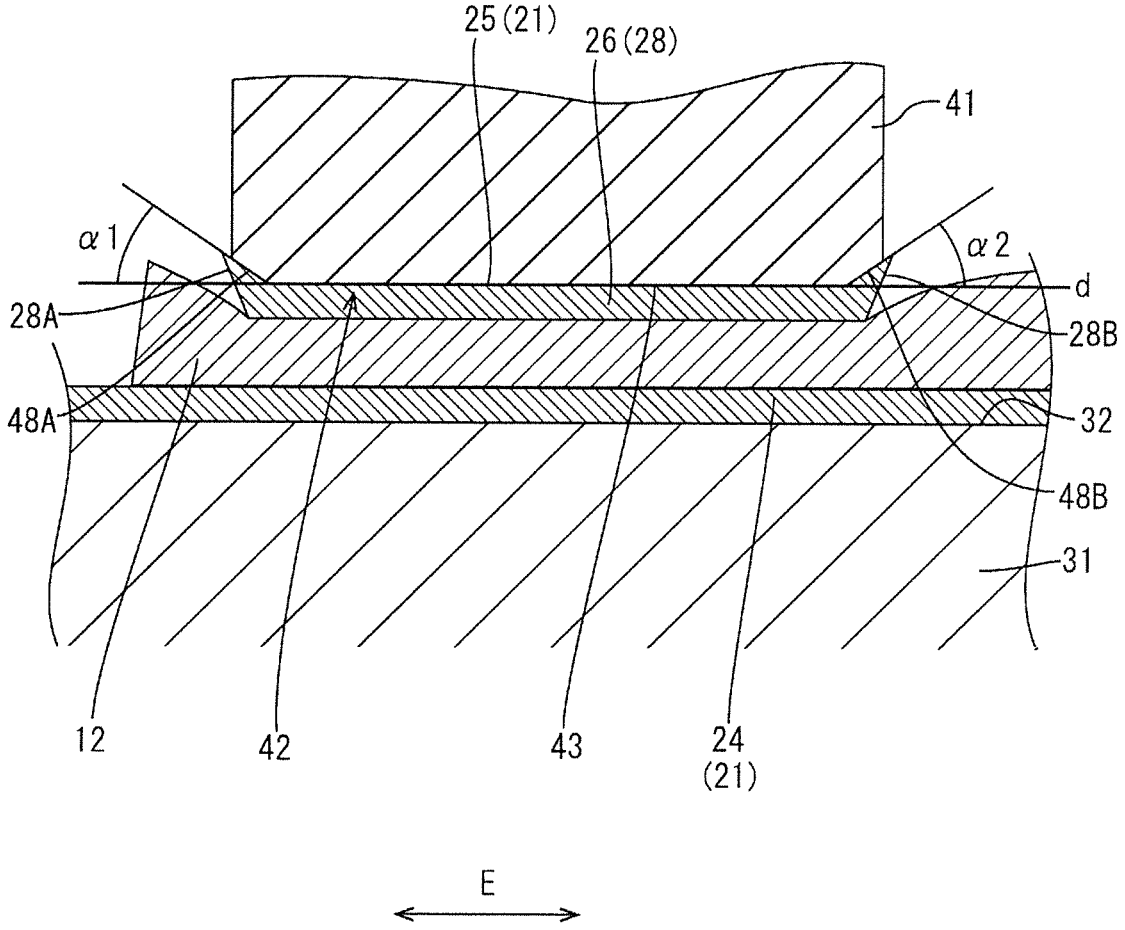
FIG. 5 is a partial enlarged side view in section conceptually showing the wire barrel crimped to the core by the crimping tool.

Out of the two tapered walls 48A, 48B, the front tapered wall 48A (example of a first inclined surface) on a front side extends obliquely to spread out toward the front from the ceiling wall 43 and parts of the side walls 44, as shown in FIGS. 2 and 4. The rear tapered wall 48B (example of a second inclined surface) on a rear side also extends obliquely to spread out toward the rear from the ceiling wall 43 and parts of the side walls 44, as shown in FIGS. 2 and 4. In this embodiment, four types of these two tapered walls 48A, 48B having different inclination angles θ1, θ2 with respect to the ceiling wall 43 of 0°, 5°, 10° and 20° were prepared.

Further in this embodiment, as shown in FIG. 4, a dimension L1 of the barrel pressing portion 42 in the front-rear direction, i.e. a dimension thereof in the extending direction E of the wire 11 is larger than a dimension L3 of the wire barrels 25 in the front-rear direction (L1>L3).

Furthermore, a dimension L2 of the ceiling wall 43 in the front-rear direction is equal to the dimension L3 of the wire barrels 25 in the front-rear direction (L2=L3).

(Production Method for Wire with Terminal 10)

The female terminal 21 is crimped to the wire 11 using the crimping tool 30. More particularly, the insulation coating 13 at the end part of the wire 11 first is stripped to expose a part of the core 12. This wire 11 (core 12 and insulation coating 13) is arranged in the front-rear direction along the bottom plate 24 of the female terminal 21 (step of placing the core 12 on the bottom plate 24).

Subsequently, the female terminal 21 having the wire 11 placed thereon is positioned and arranged on the placing surface 32 of the anvil 31. Each of the wire barrels 25 is in the form of a flat plate before being crimped to the wire 11 and rises from the bottom plate 24 toward the crimper 41 while facing the mating wire barrel 25.

Subsequently, the crimper 41 is lowered toward the wire barrels 25. Then, the wire barrels 25 butt against the side walls 44 and the ceiling wall 43 of the crimper 41 and are curved gradually along the ceiling wall 43 from the tip parts thereof. As the crimper 41 is lowered farther, the tip parts of the wire barrels 25 are directed toward the core 12 and bite into the core 12. In this way, the wire barrels 25 are crimped to the core 12 (step of winding and crimping the wire barrels 25 to the core 12 by the crimping tool 30).

At this time, both front and rear end parts of the wire barrel 25 are bent at boundaries to the body portion 26 and are extended while being pressed by the front and rear tapered walls 48A, 48B. Thus, inclination angles $\alpha 1$, $\alpha 2$ of the front and rear tapered portions 28A, 28B with respect to a ridge (d of FIG. 5) of the wire barrel 25 extending in an extending direction (front-rear direction) of the body 26 are both substantially equal to the inclination angles $\theta 1$, $\theta 2$ of the front and rear tapered walls 48A, 48B with respect to the ceiling wall 43. Note that if the inclination angles $\theta 1$, $\theta 2$ are small, the inclination angles $\alpha 1$, $\alpha 2$ may become larger than the inclination angles $\theta 1$, $\theta 2$ due to a restoring force of the wire barrel 25.

Further, the upper surfaces (surfaces facing the barrel pressing portion 42) of the front and rear tapered portions 28A, 28B are flat surfaces without being bent at intermediate positions. Furthermore, slide contact marks are formed on the upper surfaces of the front and rear tapered portions 28A, 28B due to slide contact with the front and rear tapered wall portions 48A, 48B.

(Functions and Effects)

Next, functions and effects of this embodiment are described.

According to this embodiment, the length L1 of the barrel pressing portion 42 in the front-rear direction is larger than the dimension L3 of the wire barrels 25 in the same direction (L1>L3) and the length L2 of the ceiling wall 43 in the front-rear direction is equal to the dimension L3 of the wire barrels 25 in the same direction (L2=L3).

Thus, in the process of crimping the wire barrels 25 to the core 12, the front and rear tapered walls 48A, 48B come into contact with the front and rear end parts of the wire barrels 25 that otherwise would be lifted away from the core 12 by being pressed by the ceiling portion 43, thereby suppressing excessive lifting of the end parts of the wire barrels 25. Specifically, the front and rear tapered portions 28A, 28B formed on the wire barrels 25 are not formed in the course of nature as before, but formed while the inclination angles thereof are controlled by the barrel pressing portion 42.

Figure 6:
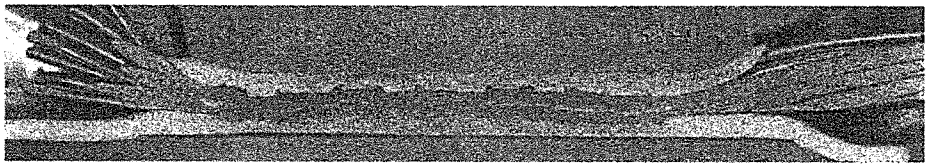
FIG. 6 is a partial enlarged section showing actual wire barrels crimped to cores by crimping tools.
Figure 6:
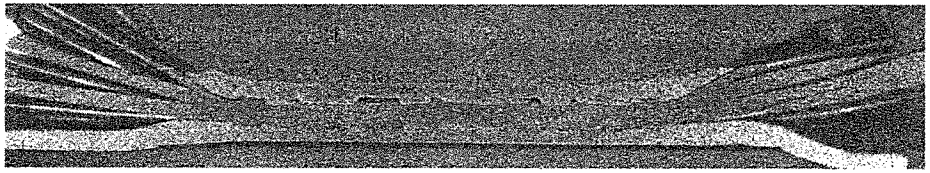
Figure 6:
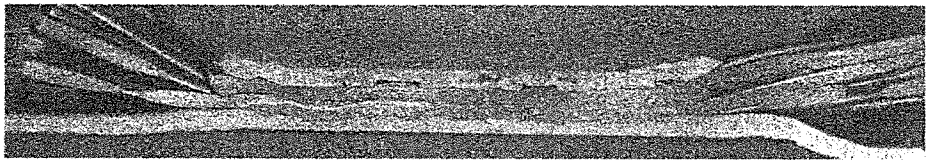
Figure 6:
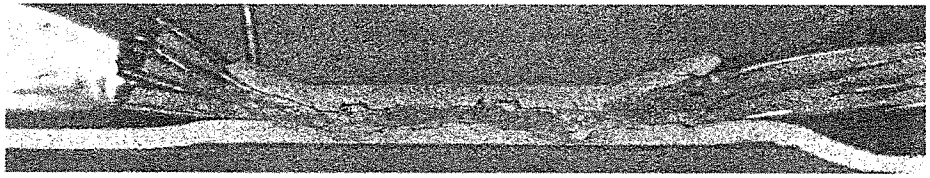
Figure 6:
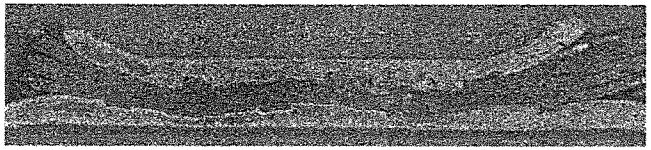
Figure 7:
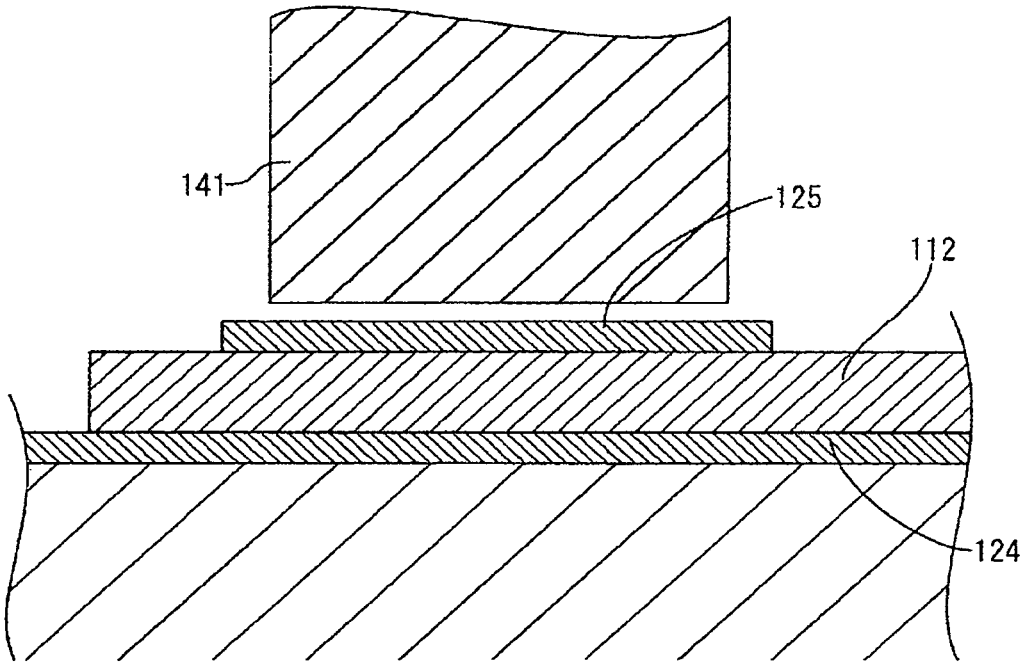
FIG. 7 PRIOR ART
FIG. 7 is a partial enlarged side view in section showing a conventional crimping tool and a wire barrel before being crimped to a core.
Figure 8:
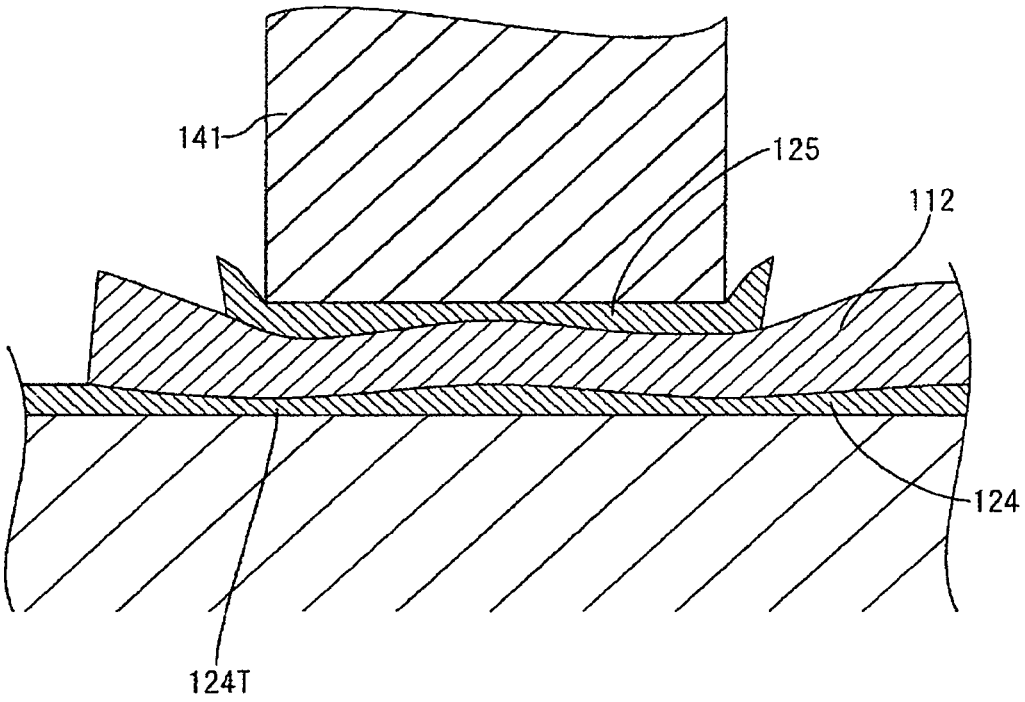
FIG. 8 PRIOR ART
FIG. 8 is a partial enlarged section showing the wire barrel crimped to the core by the conventional crimping tool.

In this way, the concentration of stress on parts (parts contacted by the end edge parts of the ceiling wall 43) of the wire barrels 25 is suppressed and partial thinning of the bottom plate 24 of the female terminal 21 is avoided. Thus, the wire with terminal 10 with high quality is obtained (see FIG. 6). Note that a partial enlarged section shown in a lowermost row of FIG. 6 shows a conventional wire with terminal for comparison.

CONCLUSION

From these results, both the inclination angles $\theta 1$, $\theta 2$ of the front and rear tapered portions 28A, 28B with respect to the ceiling wall 43 are said to be preferably within a range of 0° or larger and 20° or smaller. This is because the inclination angles are close to angles when the tapered portions 28A, 28B are formed in the course of nature and stress partially (parts contacted by the end parts of the ceiling wall 43) applied to the wire barrels 25 becomes larger if the inclination angles exceed 20°. More preferably, the inclination angles are about 10°. If the inclination angles are below about 10°, a force for fixing the wire barrels 25 to the core 12 starts decreasing.

The invention is not limited to the above described and illustrated embodiment. For example, the following embodiments also are included in a technical scope.

Although the dimension L2 of the ceiling wall 43 is set equal to the dimension L3 of the wire barrels 25 (L2=L3) in the above embodiment, the dimension L2 of the ceiling wall 43 may be smaller than the dimension L3 of the wire barrels 25 (L2<L3).

Although the inclination angles of the front and rear tapered walls 48A, 48B with respect to the ceiling wall 43 are equal in the above embodiment, these inclination angles may be different. If this configuration is adopted, the front and rear tapered portions 28A, 28B of the wire with terminal 10 are formed to have different inclination angles with respect to the ridge d extending in the extending direction of the body portion 26. Note that these inclination angles can be set arbitrarily within the range of 0° or larger and 20° or smaller.

Although the terminal to be crimped to the wire 11 is the female terminal 21 including the tubular terminal connecting portion 22 in the above embodiment, there is no limitation to this and the terminal may be a male terminal including a male tab or a so-called LA terminal obtained by forming a through hole in a metal plate material. The terminal can have an arbitrary shape according to need.

Although the wire 11 including the core 12 made of aluminum or aluminum alloy is shown in the above embodiment, a wire including a core made of another arbitrary metal such as copper or copper alloy may be employed.

Although the female terminal 21 using the material obtained by applying tin plating to the metal plate material made of copper or copper alloy is shown in the above embodiment, there is no limitation to this. For example, the terminal may be formed of a metal plate material made of aluminum or aluminum alloy. Further, tin may be used as a plating metal or plating may not be applied.

LIST OF REFERENCE SIGNS

10 . . . wire with terminal
11 . . . wire

12 . . . core
21 . . . female terminal
24 . . . bottom plate
24 . . . wire barrel
28A . . . front tapered portion (first inclined surface)
28B . . . rear tapered portion (second inclined surface)
30 . . . crimping tool
31 . . . anvil
32 . . . placing surface
41 . . . crimper
42 . . . barrel pressing portion (curved surface)
43 . . . ceiling wall (contact surface)
48A . . . first tapered wall
48B . . . second tapered wall
θ1 . . . inclination angle of first inclined surface
θ2 . . . inclination angle of second inclined surface
α1 . . . inclination angle of tapered wall (inclination angle of first incline portion)
α2 . . . inclination angle of tapered wall (inclination angle of second incline portion)
D . . . ridge
E . . . extending direction of wire

The invention claimed is:

1. A wire with terminal production method for a wire with terminal in which a terminal including a bottom plate and two wire barrels extending laterally from the bottom plate are crimped to a core exposed at an end of a wire, comprising:

positioning the core on the bottom plate to extend between first and second wire barrels in forward and backward directions;

positioning the bottom plate with the core thereon on a placing surface of a first crimping tool;

lowering a second crimping tool towards the first crimping tool, the second crimping tool having a curved surface facing the first crimping tool, the curved surface having a first inclined surface inclined out on a first end at a first inclination angle in the forward direction of the wire, a second inclined surface inclined out on a second end at a second inclination angle in the backward direction, and a contact surface located between the first and second inclined surfaces;

winding and crimping the wire barrels to the core by a pressing the second crimping tool towards the first crimping tool so that forward and backward ends of the wire barrels extend in the forward and backward directions, respectively, and are inclined towards the first and second inclined surfaces, respectively, to define first and second tapered portions;

wherein:

a dimension of the curved surface in the forward to backward direction is larger than a dimension of the wire barrels in the forward to backward direction;

a dimension of the contact surface in the forward to backward direction is equal to the dimension of the wire barrels in the forward to backward direction; and the first tapered portion is inclined at a first angle equal to the first inclination angle and the second tapered portion is inclined at a second angle equal to the second inclination angle.

2. The wire with terminal production method of claim 1, wherein the inclination angles of the first and second inclined surfaces with respect to the contact surface are both within a range of 0° or larger and 20° or smaller.

3. The wire with terminal production method of claim 1 wherein the first and second inclination angles are equal to each other.

4. The wire with terminal production method of claim 1, wherein the first inclination angle is different from the second inclination angle.

5. A crimping tool for crimping two wire barrels to a core when manufacturing a wire with terminal in which a terminal including a bottom plate and the wire barrels extending laterally from the bottom plate are crimped to the core exposed at an end of a wire, comprising:

a first tool having a placing surface on which the bottom plate and the core are to be placed; and a second tool having a curved surface for sandwiching and curving the wire barrels between the curved surface and the placing surface;

wherein:

the curved surface has a first inclined surface inclined out on a first end in an extending direction of the wire, a second inclined surface inclined out on a second end in the extending direction and a contact surface located between the first and second inclined surfaces;

a dimension of the curved surface in the extending direction is larger than a dimension of the wire barrels in the extending direction; and a dimension of the contact surface in the extending direction is equal to the dimension of the wire barrels in the extending direction.

6. The crimping tool of claim 5, wherein inclination angles of the first and second inclined surfaces with respect to the contact surface are both within a range of 0° or larger and 20° or smaller.

7. The crimping tool of claim 5 wherein the first inclination angle is different from the second inclination angle.

8. The crimping tool of claim 5 wherein the first inclination angle is different from the second inclination angle.

* * * * *